US007083462B1

(12) United States Patent
Chen et al.

(10) Patent No.: US 7,083,462 B1
(45) Date of Patent: Aug. 1, 2006

(54) ADJUSTABLE BUCKLING STRUCTURE FOR CONNECTORS

(75) Inventors: Chang-Nan Chen, Shinjuang (TW); Dan San Hung, Shinjuang (TW); Jui-Chih Hung, Shinjuang (TW)

(73) Assignee: Liang Tei Co., Ltd., Taipei Hsien (TW)

( * ) Notice: Subject to any disclaimer, the term of this patent is extended or adjusted under 35 U.S.C. 154(b) by 0 days.

(21) Appl. No.: 11/266,629

(22) Filed: Nov. 3, 2005

(51) Int. Cl.
*H01R 13/62* (2006.01)

(52) U.S. Cl. ..... 439/372; 439/362

(58) Field of Classification Search ..... 439/372, 439/157, 362, 153; 24/494, 495, 513, 517, 24/518; 292/113, 246, 247, 256.59
See application file for complete search history.

(56) References Cited

U.S. PATENT DOCUMENTS 4,682,847 A 7/1987 Moore et al.
4,904,201 A 2/1990 Pelletier
4,940,420 A 7/1990 Munie
5,030,128 A 7/1991 Herron et al.
5,083,933 A 1/1992 Colleran et al.
5,201,670 A 4/1993 Watanabe et al.
5,213,533 A 5/1993 Walden
5,324,210 A 6/1994 Brickley
5,474,465 A 12/1995 Kobayashi
5,919,055 A 7/1999 Hattori
7,037,131 B1 * 5/2006 Chen et al. ..... 439/372

* cited by examiner

*Primary Examiner*—Tho D. Ta
*Assistant Examiner*—Vanessa Girardi

(57) ABSTRACT

An adjustable buckling structure for connectors includes a connecting body, two buckling devices and two adjusting rods. The connecting body has a retaining portion formed on each lateral side. Two buckling devices are pivotally connected to two lateral sides of the connecting body, respectively. Each adjusting rod has an acentric section and two rod ends. Each buckling device includes a first and a second linkages. The first linkage has one end pivotally connected to the connecting body and includes a hook formed on the other end thereof. The second linkage has one end pivotally connected to the first linkage and includes a through hole formed on the other end. The adjusting rod is disposed in the through hole with the two rod ends protruded out from the through hole.

9 Claims, 5 Drawing Sheets

ADJUSTABLE BUCKLING STRUCTURE FOR CONNECTORS

BACKGROUND OF THE INVENTION

1. Field of Invention

The present invention relates in general to an adjustable buckling structure for connectors, and more particular, to a male and female connectors with an adjustable buckling structure to ensure a tight engagement.

2. Related Art

In view of the developing information technology and computer industry, connectors used for power and/or signal transmission are very popular. The conventional connectors used for computers or peripherals may cause insecure engagement after repeatedly plugging and unplugging or under unavoidably shaking such as those connectors used for printers, copy machines or laptop computers. Typically, a buckling mechanism is provided between two mated connectors to prevent disengagement. Therefore, it is a desire to pursue a reliable buckling mechanism for connectors to provide an adjustable and convenient engagement.

SUMMARY OF THE INVENTION

The present invention is to provide an adjustable buckling structure for connectors, which utilize an acentric adjustor to prevent and overcome the insecure engagement problem between two connectors to prolong the product life.

Accordingly, an adjustable buckling structure for connectors of the present invention includes a connecting body, two buckling devices and two adjusting rods. The connecting body has a retaining portion formed on each lateral side. Two buckling devices are pivotally connected to two lateral sides of the connecting body, respectively. Each adjusting rod has an acentric section and two rod ends. Each buckling device includes a first and a second linkages. The first linkage has one end pivotally connected to the connecting body and includes a hook formed on the other end thereof. The second linkage has one end pivotally connected to the first linkage and includes a through hole formed on the other end. The adjusting rod is disposed in the through hole with the two rod ends protruded out from the through hole.

Moreover, the adjustable buckling structure for connectors of the present invention further includes a receiving body and two buckling seats located on the receiving body beside the receiving port, respectively. Each buckling seat has two opposite arms with two corresponding locking holes formed thereon. Each of two facing surfaces of two opposite arms is formed a guiding slot connecting to the locking hole.

BRIEF DESCRIPTION OF THE DRAWINGS

The present invention will become more fully understood from the detailed description given hereinbelow illustration only, and thus are not limitative of the present invention, and wherein.

DETAILED DESCRIPTION OF THE INVENTION

Figure 1:
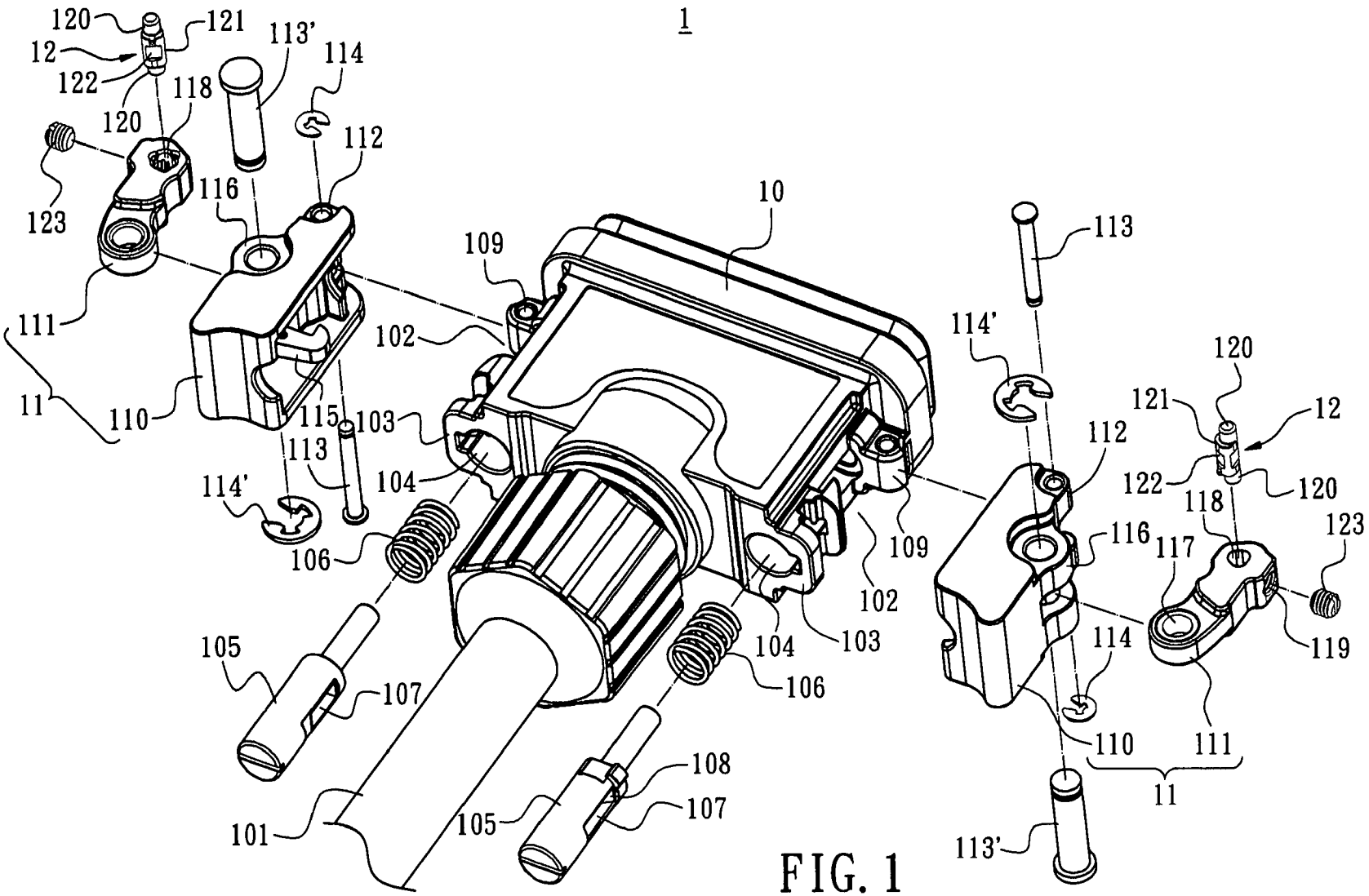
FIG. 1 shows the perspective view of an adjustable buckling structure for connectors including only a first connector.
Figure 2:
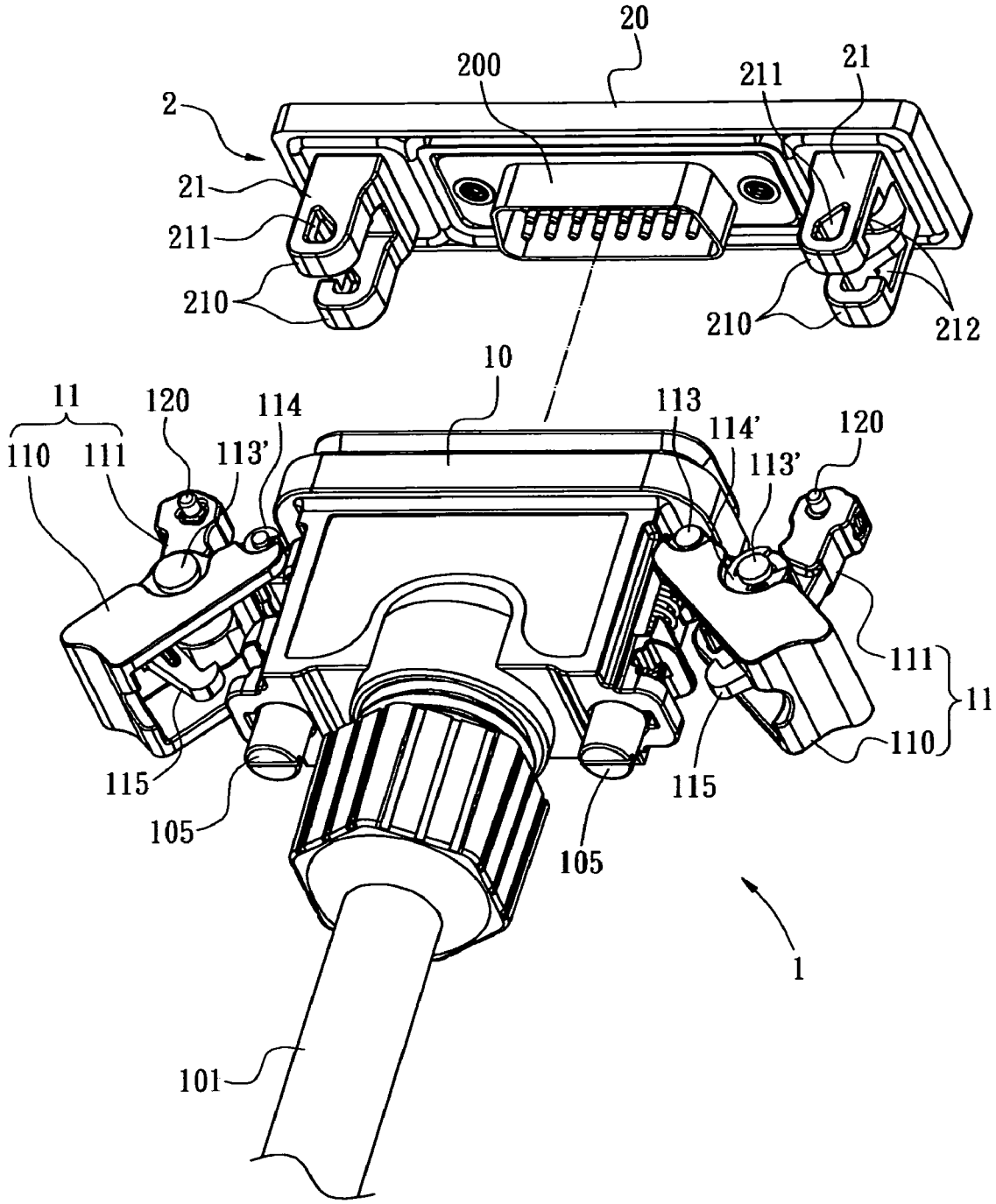
FIG. 2 shows the perspective view of an adjustable buckling structure for connectors including both the first connector and a second connector.

Referring to FIGS. 1 and 2, an adjustable buckling structure for two connectors 1 and 2 of the present invention is shown. In the preferred embodiment, the first connector 1 is a female plug, which includes a connecting body 10, two buckling devices 11 and two adjusting rod 12.

Figure 5:
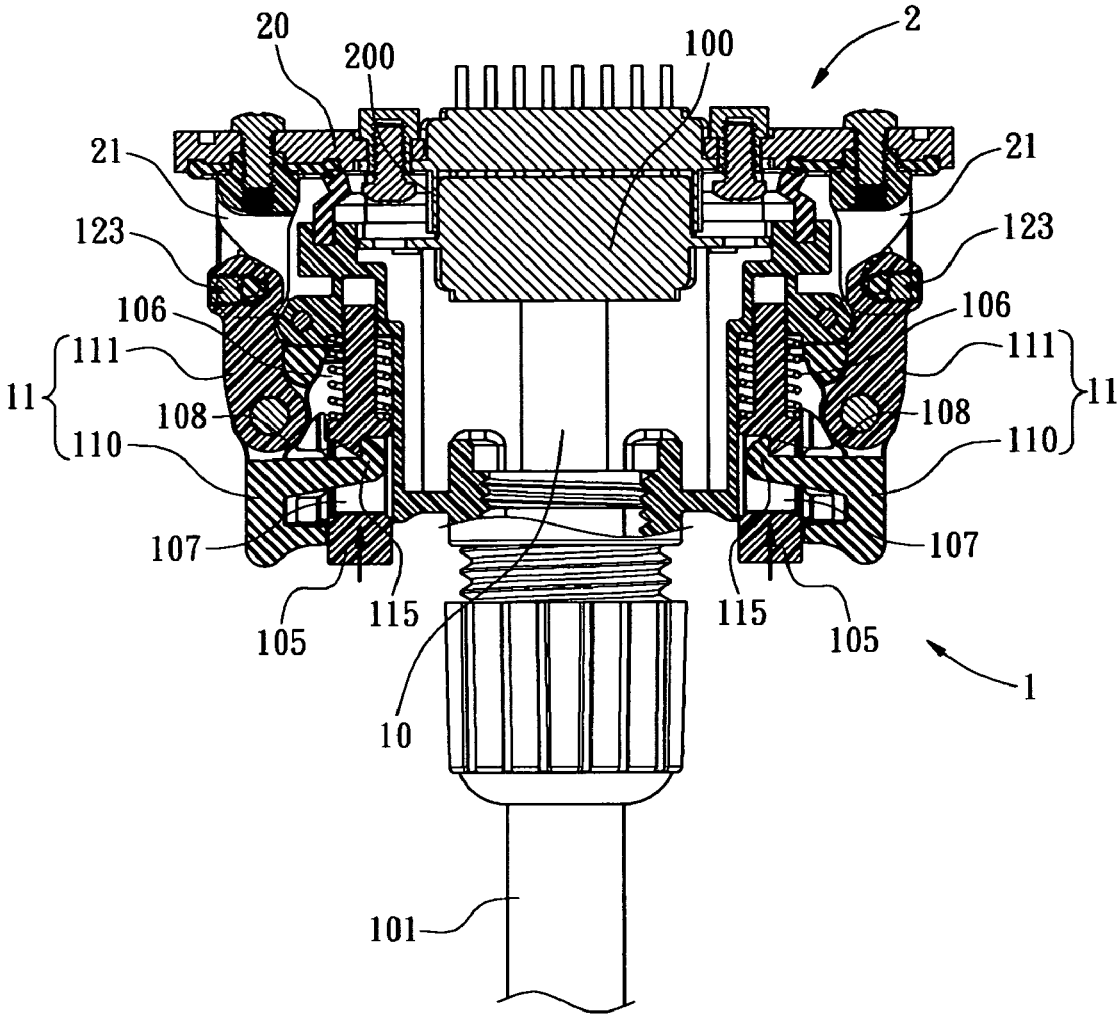
FIG. 5 shows a cross sectional view of the engaged first and second connectors.

The connecting body 10 includes a connecting port 100 (as shown in FIG. 5) with a cord 101 extended from rear and a recess 102 formed on each lateral side. A protrusion 103 abutted to the rear surface of the connecting port 100 is formed on each recess 102. A bore 104 is formed on each protrusion 103 to connect the recess 12. A pushing rod 105 is provided to insert in the bore 104. A spring 106 is disposed in the recess to receive the pushing rod 105 with one end to pass through. A slot 107 with a retaining portion 108 is formed on each pushing rod 105. A first pivotal portion 109 adjacent to the front of the connecting port 100 is formed on each recess 102.

Two buckling devices 11 are pivotally connected to two lateral sides of the connecting body 100, respectively. Each buckling device 11 includes a first linkage 110 and a second linkage 111. The first linkage 110 has a second pivotal portion 112 formed at one end to pivotally connect to the connecting body 100 at the first pivotal portion 109 by a shaft pin 113 passing through and a C-ring 114 locking at the end. Moreover, the first linkage 110 provides a hook 115 and a third pivotal portion 116. The second linkage 111 has a fourth pivotal portion 117 formed at one end to pivotally connect to the first linkage 110 at the third pivotal portion 116 by another pin shaft 113' passing through and another C-ring 114' locking at the end. Moreover, the second linkage 111 provides a vertical through hole 118 and a lateral threaded hole 119 connecting the through hole 118 at the other end.

Each adjusting rod 12 is disposed in the through hole 118 of the second linkage 111. Two rod ends 120 of the adjusting rod 12 will protrude out the through hole 118 from either end and an acentric section 12 between two rod ends 120 has a plurality of retaining surfaces 122. Preferably, each rod end 120 has a circular shape in cross section. Moreover, a pressing element 123 is disposed in the threaded hole 119 to screw against on one retaining surface 122 so that each adjusting rod 12 can be fixedly secured in the through hole 118 of the second linkage 111.

Furthermore, as shown in FIG. 2, the second connector 2, as a male socket in the preferred embodiment, for mating with the first connector 1 includes a receiving body 20 and two buckling seats 21. The receiving body 20 has a receiving port 200 corresponding to the connecting port 100 of the first connector 10. Two buckling seats 21 are fixedly located on the receiving body 20 beside the receiving port 200, respectively. Each buckling seat 21 has two opposite arms 210 with two corresponding locking holes 211 formed thereon. Each of two facing surfaces of two opposite arms 210 is formed a guiding slot 212 connecting to the locking hole 211.

Figure 3:
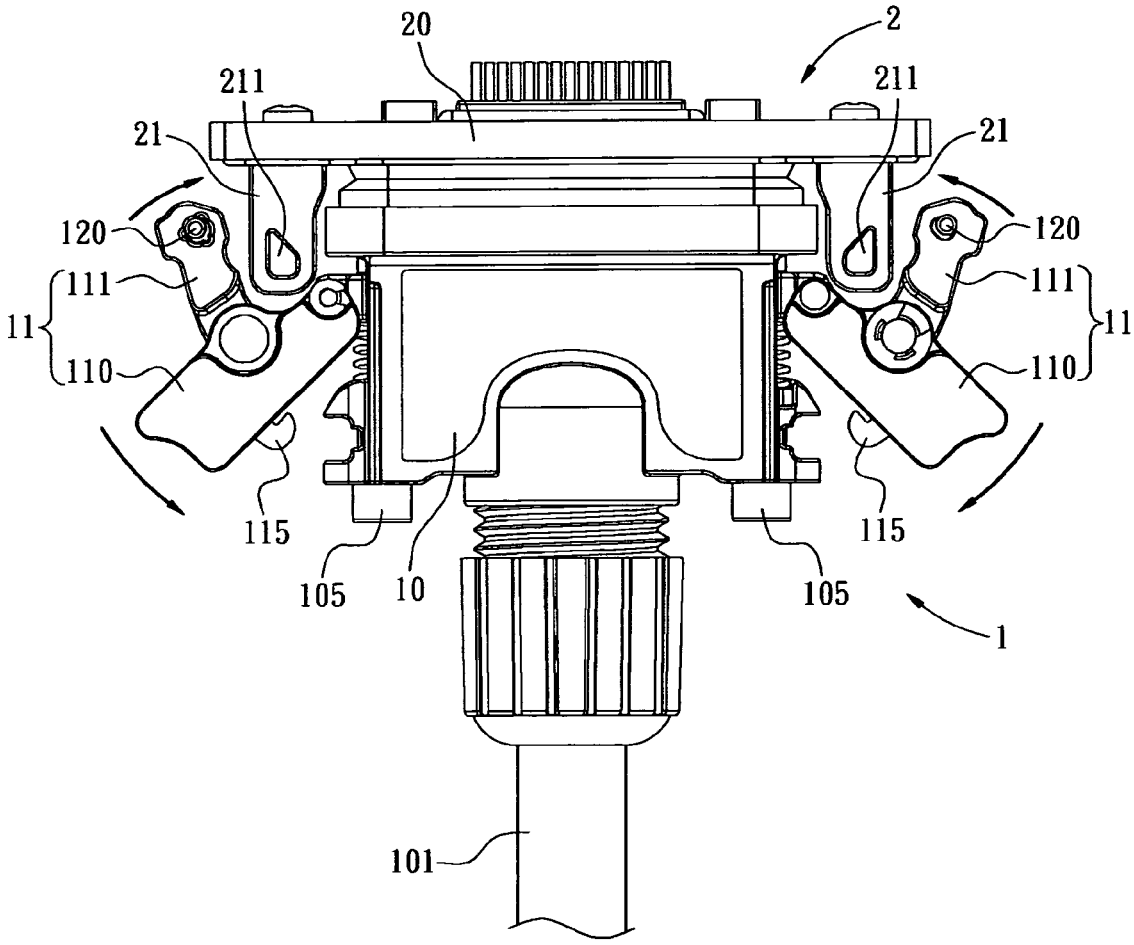
FIG. 3 shows the first and second connectors are mating to each other.
Figure 4:
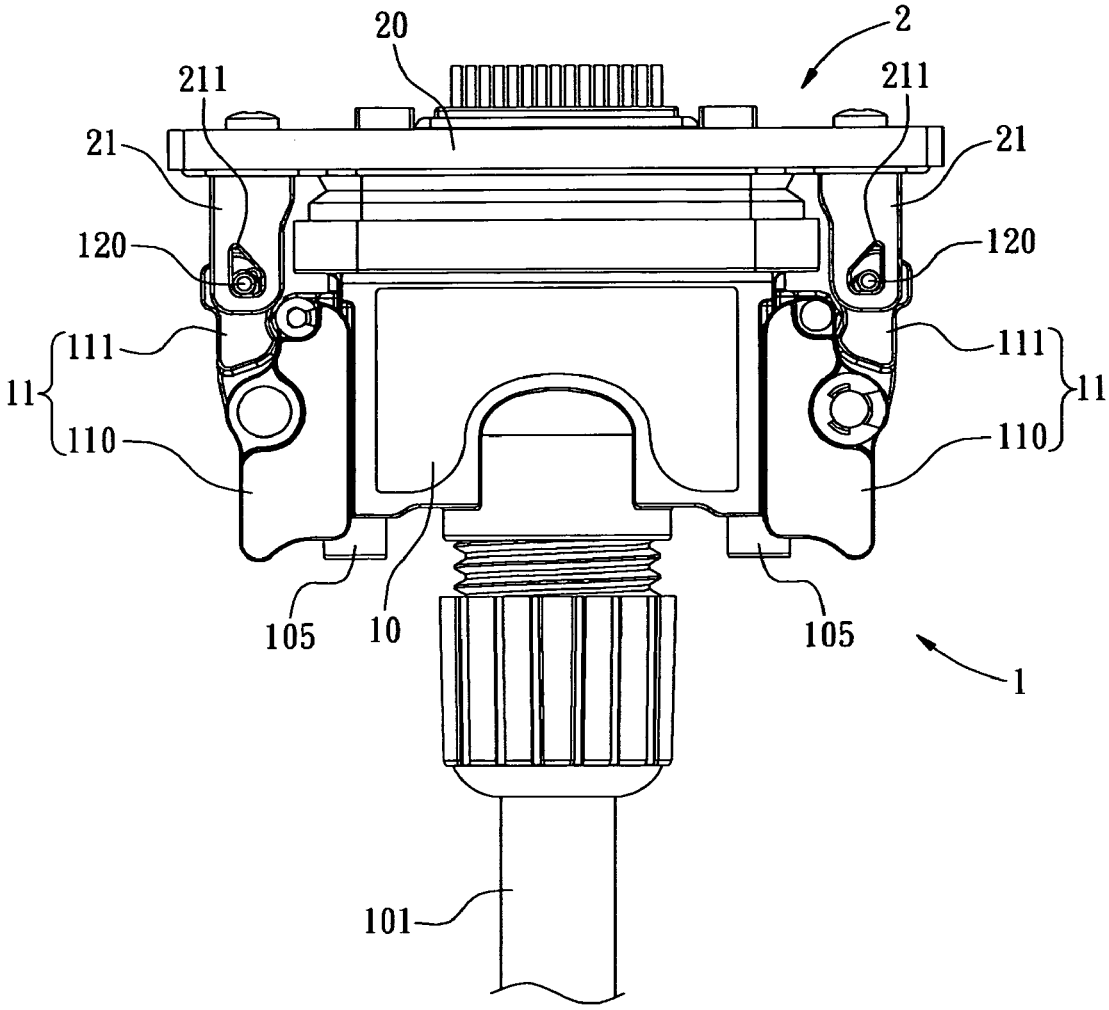
FIG. 4 shows the first and second connectors have been securely engaged to each other.

Accordingly, when the first connector 1 is plugging to the second connector 2, the first linkage 110 of each buckling device 11 is turned forwardly to make the second linkage 111 approaching to the buckling seat 21, as shown in FIG. 3. After two rod ends 120 of the adjusting rod 12 slide in two locking holes 211 through two guiding slots 212, respectively, each first linkage 110 is turned backwardly to make the hook 115 pressing in the slot 107 and clamping on the retaining portion 108 of the pushing rod 105. As such, the first connector 1 is securely engaged with the second connector 2, as shown in FIG. 4.

As shown in FIG. 5, when release the buckling device 11 to disengage the first and second connectors 1 and 2, simply push on each pushing rod 105 to loosen the hook 115 from the retaining portion 108. Such that, each first linkage 110 can be turned forwardly again to move the adjusting rod 2 out from the locking holes 211 of the buckling seat 21, and the first connector 1 is unplugged from the second connector 2.

The present invention utilizes the adjusting rod 12 to change the distance between two rod ends 120 and the hook 115 of the first linkage 110. When the distance between two rod ends 120 and the hook 115 is smaller, a buckling mechanism of the buckling device 11 and the buckling seat 221 is tighter. Therefore, it merely needs to screw the pressing element 123 against different retaining surface 122 of the adjusting rod 12, the distance between two rod ends 120 and the hook 115 can be adjusted to obtain suitable tightness of the buckling mechanism. That is, the present invention can utilize the adjusting rod 12 to prevent and overcome the insecure engagement problem between two connectors to prolong the product life.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An adjustable buckling structure for electrical connectors comprises:

a connecting body with two buckling devices pivotally connected to two lateral sides of the connecting body; respectively; and two adjusting rods each having an adjusting section and two rod ends, wherein each buckling device includes first and second linkages, the first linkage has one end pivotally connected to the connecting body and includes a hook formed on the other end threof, the second linkage has one end pivotally connected to the first linkage and includes a through hole formed on the other end, and the adjusting rod is disposed in the through hole wherein the two rod ends protrude out from both sides of the through hole.

2. The adjustable buckling structure for electrical connectors of claim 1, wherein the connecting body includes two recesses formed on the two lateral sides.

3. The adjustable buckling structure for electrical connectors of claim 2, wherein the connecting body includes a protrusion formed on each recess abutted a rear surface thereof, and a bore is formed on each protrusion to connect with the recess.

4. The adjustable buckling structure for electrical connectors of claim 3, further comprising a pushing rod inserted into each bore wherein a spring disposed in each recess receives one end of the pushing rod and a retaining portion is formed in each pushing rod.

5. The adjustable buckling structure for electrical connectors of claim 4, wherein each pushing rod includes a slot and the retaining portion is formed in the slot.

6. The adjustable buckling structure for electrical connectors of claim 1, wherein the second linkage includes a threaded hole that communicates with the through hole, and a pressing element is disposed in the threaded hole.

7. The adjustable buckling structure for electrical connectors of claim 6, wherein the adjustable section includes a plurality of retaining surfaces for the pressing element to screw against.

8. The adjustable buckling structure for electrical connectors of claim 1, wherein each rod end has a circular in cross section.

9. The adjustable buckling structure for electrical connectors of claim 1, further comprising:

a receiving body having two buckling seats located beside a receiving port, respectively, wherein each buckling seat has two opposite arms with two corresponding locking holes formed thereon, and two facing surfaces on each of the two opposite arms has formed thereon a guiding slot in communication with the locking hole.

* * * * *